US006074812A

United States Patent [19]

Chari

[11] Patent Number: 6,074,812

[45] Date of Patent: Jun. 13, 2000

[54] METHOD FOR DESALTING AND DEWATERING OF SILVER HALIDE EMULSIONS BY ELECTRODIALYSIS

[75] Inventor: Krishnan Chari, Fairport, N.Y.

[73] Assignee: Eastman Kodak Company, Rochester, N.Y.

[21] Appl. No.: 09/312,379

[22] Filed: May 14, 1999

[51] Int. Cl.[7] ..... G03C 1/015

[52] U.S. Cl. ..... 430/569

[58] Field of Search ..... 430/567, 569

[56] References Cited

U.S. PATENT DOCUMENTS

| | | | |
|---|---|---|---|
| 3,925,175 | 12/1975 | Fisch et al. | 205/571 |
| 5,223,388 | 6/1993 | Saitou | 430/569 |
| 5,523,201 | 6/1996 | Nimura et al. | 430/569 |
| 5,605,790 | 2/1997 | Nimura et al. | 430/569 |
| 5,702,879 | 12/1997 | Barcock | 430/569 |
| 5,928,853 | 7/1999 | Yamamoto | 430/569 |

*Primary Examiner*—Mark F. Huff
*Attorney, Agent, or Firm*—Andrew J. Anderson

[57] ABSTRACT

A method for desalting and dewatering a silver halide emulsion comprising removing soluble salts from the silver halide emulsion by electrodialysis, wherein the electrodialysis is carried out by passing a feed stream of the emulsion between an anion-exchange membrane and a cation-exchange membrane while a direct current voltage is applied between the anion-exchange and cation-exchange membranes so that ions are removed from the feed stream and transferred to a waste stream on the sides of the anion-exchange and cation-exchange membranes opposite to the feed stream, wherein a soluble material is added to the waste stream at a higher concentration with respect to the feed stream so as to establish a concentration gradient between the waste stream and the feed stream which drives osmotic dewatering of the feed stream during electrodialysis. It is possible to achieve simultaneous deionization and dewatering using electrodialysis within a reasonable process time by adding a soluble component to the waste stream to generate a concentration gradient whereby water is effectively transferred from the feed to the waste concentrate stream by direct osmosis as well as removal of water by ionic hydration during electrodialysis. This process has the advantage that interactions with the emulsion being deionized does not place any restriction on the soluble component that is used to establish the concentration gradient between the feed and waste streams, because the component is not added to the emulsion feed stream. In a particular embodiment, the concentration gradient is established by adding a salt to the waste electrodialysis stream. In a preferred embodiment, relatively high water content or high porosity ion-exchange membranes are used in combination with a high level of salt (or other component) in the concentrate or waste stream.

15 Claims, 2 Drawing Sheets

METHOD FOR DESALTING AND DEWATERING OF SILVER HALIDE EMULSIONS BY ELECTRODIALYSIS

FIELD OF THE INVENTION

The present invention relates a method of desalting and dewatering (concentration) of silver halide photographic emulsions, and more particularly, desalting and dewatering of silver halide emulsions by electrodialysis.

BACKGROUND OF THE INVENTION

Silver halide photographic emulsions are typically prepared by combining aqueous solutions of silver salt with halide salt in the presence of a gelatino-peptizer protective colloid. Following precipitation of silver halide crystals, excess salts may be removed by a variety of techniques as disclosed in the prior art, including a coagulation process in which a protective colloid is coagulated with a coagulating agent and the resulting supernant solution is removed, as disclosed in Japanese Kokais JP-A 48-13057, 59-166939, 60-220337, 60-52844, 62-212642, 62-237993, 63-214743 and 2-272442; a noodle washing method in which an emulsion is cooled down to be set and shredded in the form of noodles to be washed as disclosed, for example, in JP-A 47-44487 and 49-46255; and ultrafiltration by use of high pressures and a semipermeable membrane, as disclosed in JP-A 57-209823, 59-43727, 62-113137, 2-172816, 2-172817 and 3-140946.

More recently, processes of applying ion-exchange or electrodialysis have been suggested to overcome various problems associated with prior emulsion desalting methods, as disclosed in, e.g., JP-A 61-219948, 62-23035, 63-40137, 63-40039 and 4-22942. FIG. 1 is a schematic illustration showing the manner of electrodialysis. In FIG. 1, a salt in a feed solution circulated through pump $P_1$ is dissociated into a cation (e.g., $Na^+$) and an anion (e.g., $NO_3^-$). C indicates a cation-exchange membrane which permits only cations to pass therethrough, while A indicates an anion-exchange membrane which permits only anions to pass therethrough. A cathode (−) is placed in the outside of the C-membrane and an anode (+) is placed in the outside of the A-membrane. When a direct current voltage is applied between both electrodes, cations in the solution are attracted toward the cathode, passing through the C-membrane to reach the cathode, while anions are attracted toward the anode, passing through the A-membrane to reach the anode. The cations and anions are transferred to a waste stream circulated through pump $P_2$. Anions transferred to the anode-side and cations transferred to the cathode-side cannot pass through the A-membrane and C-membrane, respectively. Since ions which have passed through the ion-exchange membrane cannot return to the original solution, desalting is consequently accomplished.

The main commercial applications of electrodialysis are in desalting of sea water or brackish water. In these applications it is important to achieve high efficiency of deionization and minimum loss of water. As stated above, however, silver halide emulsions are desirably simultaneously dewatered (i.e., concentrated) as well as deionized during washing. Deionization is easily achieved by conventional electrodialysis, and in the course of electrodialysis ions are transferred with water molecules hydrated to the ions, thereby concentrating the emulsion to a slight degree. The amount of salt that is usually present in the emulsion (or feed stream) after precipitation, however, is typically not sufficient to achieve the desired amount of dewatering as a result of ionic hydration.

U.S. Pat. No. 5,523,201 discloses a process in which additional salt is added to a silver halide emulsion during electrodialysis to achieve a desired level of dewatering. However, the addition of extra salts to the emulsion may have detrimental effects on the stability and performance of the emulsion. Furthermore, one is severely restricted in terms of the type of salt that can be added to the emulsion. Halide salts such as sodium chloride, e.g., cannot be used because of concerns around ripening of the emulsion. High levels of divalent or higher valency salts may cause precipitation of the gelatin in the emulsion. While the use of additional nitrate salts in the feed such as sodium or potassium nitrate may minimize effects upon the emulsion, there are ecological concerns about the level of nitrate in the effluent. It would therefore be advantageous to devise an efficient process for deionizing and dewatering an emulsion by electrodialysis where one does not have to add additional salt to the feed.

SUMMARY OF THE INVENTION

In accordance with one embodiment of the invention, an improvement in a method for desalting and dewatering a silver halide emulsion comprising removing soluble salts from the silver halide emulsion by electrodialysis is disclosed, wherein said electrodialysis is carried out by passing a feed stream of the emulsion between an anion-exchange membrane and a cation-exchange membrane while a direct current voltage is applied between the anion-exchange and cation-exchange membranes so that ions are removed from the feed stream and transferred to a waste stream on the sides of the anion-exchange and cation-exchange membranes opposite to the feed stream, the improvement wherein a soluble material is added to the waste stream at a higher concentration with respect to the feed stream so as to establish a concentration gradient between the waste stream and the feed stream which drives osmotic dewatering of the feed stream during electrodialysis.

The inventor has determined that it is possible to achieve simultaneous deionization and dewatering using electrodialysis within a reasonable process time by adding a soluble component to the waste stream to generate a concentration gradient whereby water is effectively transferred from the feed to the waste concentrate stream by direct osmosis as well as removal of water by ionic hydration during electrodialysis. This process has the advantage that interactions with the emulsion being deionized does not place any restriction on the soluble component that is used to establish the concentration gradient between the feed and waste streams, because the component is not added to the emulsion feed stream. In a particular embodiment, the concentration gradient is established by adding a salt to the waste electrodialysis stream. In a preferred embodiment, relatively high water content or high porosity ion-exchange membranes are used in combination with a high level of salt (or other component) in the concentrate or waste stream.

DETAILED DESCRIPTION OF THE INVENTION

Figure 1:
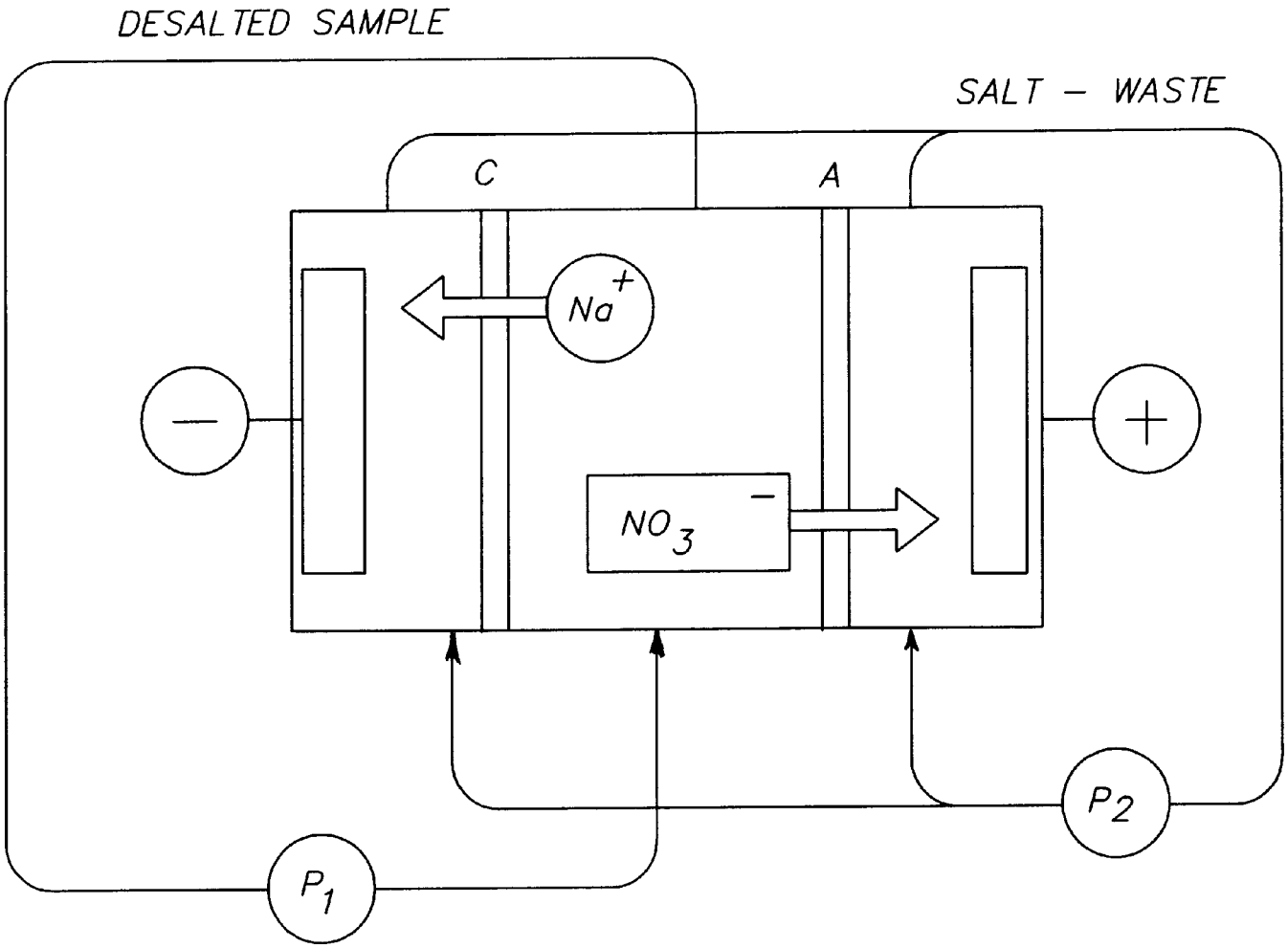
FIG. 1 is a schematic illustration indicating a desalting process by electrodialysis.

Photographic silver halide emulsions are typically prepared by reacting silver nitrate with halide salts such as sodium chloride, potassium bromide or a small amount of silver iodide to precipitate silver halide crystals, wherein extraneous salts such as sodium nitrate, potassium nitrate, or excess sodium chloride or potassium bromide are produced or remain so that the removal of these salts is necessitated. In accordance with the invention, such salts are removed by electrodialysis.

Electrodialysis is typically carried out in such a manner that an ion-containing feed solution is placed in between an anion-exchange membrane and a cation-exchange membrane with a waste solution on the opposite sides of such membranes, and a direct current voltage is applied between the anion- and cation-exchange membranes so that anions are transferred through the anion-exchange membrane to the anode side and cations are transferred through the cation-exchange membrane to the cathode side, ions being removed from the solution placed between the membranes and transferred into the waste solution. The feed and waste solutions may be fed into the electrodialysis machine with concurrent or countercurrent flows. In the course of electrodialysis, the ions are transferred with water molecules hydrated to the ions. Resultantly, water is also removed from the solution to be desalted by ionic hydration in proportion to the amount of transferable ions contained in the solution.

In order to further concentrate an emulsion beyond that accomplished by removal of water molecules hydrated to the excess ions of a formed emulsion, the prior art suggests adding large additional amounts of salts to an emulsion being deionized, as subsequent removal of such additional salt ions will result in removal of additional water by ionic hydration. The instant invention, to the contrary, is directed towards adding soluble components to the waste electrodialysis stream to establish a concentration gradient and thereby facilitate additional dewatering of the emulsion during electrodialysis by direct osmosis.

The soluble components added to the waste electrodialysis stream in accordance with the invention are preferably added to establish an initial concentration level at least twice that the component concentration level in the emulsion feed stream. The soluble component concentration gradient which drives dewatering by direct osmosis in accordance with the invention may be conveniently established by adding relatively high concentration of salts to the electrodialysis waste stream. While a low level of salts (e.g., 0.2 to 0.4M of monovalent electrolyte) is typically initially included in an electrodialysis waste stream to provide an aim conductivity in the range of 10 to 20 mS/cm in order to maintain current density, initial substantially higher levels are generally not used in order to minimize final waste stream ion concentrations. In preferred embodiments of the invention, salts are added at levels substantially above that typically used in the prior art (e.g., greater than or equal to 1.5M of monovalent electrolyte, more preferably greater than or equal to 2.0M and most preferably greater than or equal to 5.0M). Upper concentration limits may be only limited by solubility factors. Nitrate salts may be conveniently used, as these are typically removed from the emulsion, and accordingly their use in the waste stream would not necessitate separate disposal needs. Preferred initial waste stream nitrate concentrations may be from 15 to 85%, more preferably 20 to 85% and most preferably 50–85% weight/vol (grams of salt per 100 ml of solution). In addition to nitrate salts, it is possible to use other salts such as halides or multivalent electrolytes, or ionic polymeric materials, even where such components may be known to have potentially adverse reactions with emulsions, as the salt or polymer is added to the waste stream, and the electrodialysis current prevents transference of the added ionic component to the emulsion feed stream. Even nonionic soluble materials (e.g., sugars, nonionic polymers, starches, etc.) may be used to provide an osmotic gradient, as long as they are not substantially transferred through the ion-exchange membranes to the emulsion feed stream.

Ion-exchange membranes usable in the electrodialysis process in accordance with the invention may be selected from various commercially available membranes, or there may be used a membrane synthesized for a specific purpose. As the primary commercial applications of electrodialysis are in desalination of sea water as discussed above, considerable effort has been made by manufacturers to design membranes that transfer the least amount of water via osmosis or electroosmosis (cf. Transport Phenomena in Membranes by N. Lakshminarayanaiah, Academic Press, New York 1969). These membranes are characterized by low water content or porosity. In accordance with preferred embodiments of the invention, however, relatively high water content or high porosity ion-exchange membranes are used. Porosity of a membrane is indicated by a manufacturer in terms of mean water content, expressed in terms of grams of water per gram of dry membrane. Use of ion-exchange membranes having a mean water content of at least 0.35 is preferred in accordance with the invention, and more preferably at least 0.45. Preferred upper limits of water content for ion-exchange membranes for use in the invention is about 0.5, as higher levels may have a detrimental effect on perm selectivity. Such relatively high porosity membranes are particularly preferred for use in combination with a high level of salt in the concentrate or waste stream, where the applied direct current voltage inhibits transfer of the added component from the waste stream to the emulsion feed stream.

Photographic emulsions typically are formed in the presence of a protective colloidal stabilizer or gelatino-peptizer. Any conventional gelatin may be used as protective colloid present in the emulsions which are deionized in accordance with the present invention. Examples of emulsions and colloidal stabilizers are described in Research Disclosure, Number 36544 of September 1994. Research Disclosure is published by Kenneth Masons Publications Ltd., Dudley House, 12 North Street, Emsworth, Hampshire PO10 7DQ, England. This publication will be identified hereafter by the term "Research Disclosure". Emulsions for which the described new desalting process can be used are described in, for example, Research Disclosure Sections I, II and III and the publications and patents cited therein. Emulsions applicable for use in the deionizing and dewatering method of the present invention are not particularly limitative, and it is specifically contemplated that the process of the invention may be employed to deionize and dewater a fine grain emulsion to be supplied in an emulsion preparation by a fine grain-supplying method as discussed in U.S. Pat. No. 5,523,201 referenced above. Useful colloidal vehicles for the emulsions are described in Research Disclosure Section IX and the publications cited therein.

Effective electrodialysis of an emulsion containing gelatin requires that the pH of the emulsion is adjusted to near the isoelectric point of the gelatin to allow for removal salts with minimum fouling of the ion-exchange membranes. In the present invention, the term, "isoelectric point" means, as well-known in the art, a pH value at which positive and negative charges of an ampholytic material are equivalent with each other. The isoelectric point can be determined by measuring a pH at which a net charge of the ampholytic material solution is reduced to zero by ion-exchanging treatment. In accordance with preferred embodiments of the invention, the electrodialysis is carried out at a pH within of from 0.5 below the isoelectric pH of the gelatin present as a protective colloid in the emulsion to 0.5 above the isoelectric pH, more preferably within a range of plus or minus 0.2 of the isoelectric pH, and most preferably at the isoelectric pH.

The invention will be further illustrated in accordance with the following examples.

EXAMPLE 1

Figure 2:
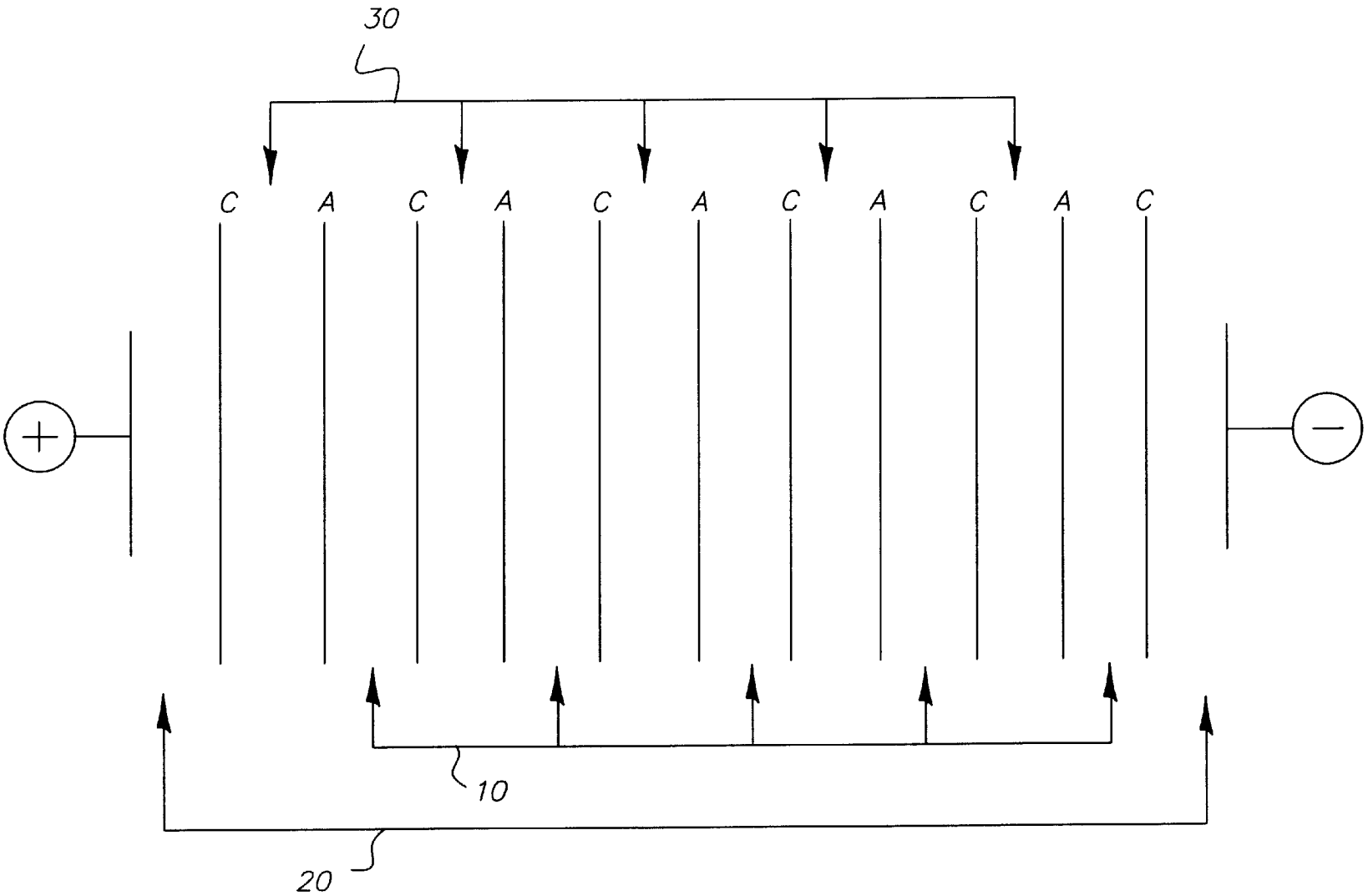
FIG. 2 is a schematic illustration of a desalting apparatus used in Examples 1 and 2.

Electrodialysis experiments were conducted using five pairs of anion and cation transfer membranes (total membrane area of 0.05 $m^2$) and an applied voltage of 2 volts per membrane pair. The construction of the cell is illustrated in FIG. 2, where C refers to a cation transfer membrane, A refers to an anion transfer membrane, 10 refers to a feed stream, 20 refers to a electrode rinse stream, and 30 refers to a concentrate or waste stream. Each of the feed, electrode rinse, and waste streams are recirculated with pumps (not shown). Various combinations of membranes having different porosities (as characterized by water content of the membrane) were examined as indicated in Table 1. In all cases, a feed stream comprising 1000 mL of aqueous solution containing 0.5% w/v Type IV gelatin (isoelectric pH approx. 5.0) and 0.7M sodium nitrate and an electrode rinse stream comprising 0.5M sodium carbonate in water were used. The initial composition of the waste stream (or concentrate stream) was either 10% w/v (i.e., 10 g/100 mL) or 80% w/v (80 g/100 mL) sodium nitrate. The pH of the feed stream was adjusted to 5.0 prior to starting each experiment. The flow rates of the feed, concentrate and rinse streams were 0.5, 0.5, and 0.4 liters per minute, respectively. Shown below are the amounts of water transferred from the feed stream to the concentrate stream:

| Ex. | Anionic Membrane (Mean Water Content) | Cationic Membrane (Mean Water Content) | Waste Stream sodium nitrate concentration (g/100 mL) | Water removed from Feed in 90 minutes (mL) |
|---|---|---|---|---|
| 1.1 | Neosepta AMX (0.28) | Neosepta CMX (0.28) | 10 | 153 |
| 1.2 | Neosepta AMX (0.28) | Neosepta CMX (0.28) | 80 | 230 |
| 1.3 | Neosepta AFN (0.48) | Neosepta CMX (0.28) | 10 | 217 |
| 1.4 | Neosepta AFN (0.48) | Neosepta CMX (0.28) | 80 | 343 |

The above data demonstrates that employing a relatively higher concentration of salt in the waste stream in accordance with Exs. 1.2 and 1.4 results in a significant increase in the amount of water removed from the feed stream over a given time of operation in comparison to the use of lower levels of salt in the waste stream (Exs. 1.1 and 1.3). The use of an ion exchange membrane having a relatively high porosity (Exs. 1.3 and 1.4) in accordance with a preferred embodiment of the invention also results in increased dewatering (compared to Exs. 1.1 and 1,2, respectively), with the combination of a high porosity membrane and a high concentration of salt in the waste stream (Ex. 1.4) resulting in a level of water removal greater than that which would be predicted from the individual results of Exs. 1.2 and 1.3.

EXAMPLE 2

A fine grain silver chloride cubic emulsion (0.2 micron average cube size) was treated using the equipment and conditions described in Example 1, with a Neosepta AFN anionic membrane (mean water content 0.48) and a Neosepta CM-1 cationic membrane (mean water content 0.38), and a waste concentrate stream comprising 80% w/v (80 g/100 mL) sodium nitrate in water. After 180 minutes of operation, the conductivity of the emulsion was reduced from an initial level of 52 mS/cm to a final level of 5 mS/cm, while the concentration of the emulsion was increased from an initial level of 0.59 moles Ag/kg to a final level of 1.07 moles Ag/kg, demonstrating effective simultaneous deionization and dewatering of the feed emulsion.

The invention has been described in detail with particular reference to certain preferred embodiments thereof, but it will be understood that variations and modifications can be effected within the spirit and scope of the invention.

What is claimed is:

1. In a method for desalting and dewatering a silver halide emulsion comprising removing soluble salts from the silver halide emulsion by electrodialysis, wherein said electrodialysis is carried out by passing a feed stream of the emulsion between an anion-exchange membrane and a cation-exchange membrane while a direct current voltage is applied between the anion-exchange and cation-exchange membranes so that ions are removed from the feed stream and transferred to a waste stream on the sides of the anion-exchange and cation-exchange membranes opposite to the feed stream, the improvement wherein a soluble salt is added to the waste stream at an initial higher concentration with respect to the feed stream so as to establish a concentration gradient between the waste stream and the feed stream which drives osmotic dewatering of the feed stream during electrodialysis.

2. The method of claim 1, wherein said salt is potassium nitrate.

3. The method of claim 1, wherein said salt is sodium nitrate.

4. The method of claim 1, wherein the waste stream initial salt concentration is at least 1.5M monovalent electrolyte.

5. The method of claim 1, wherein the waste stream initial salt concentration is at least 2.0M monovalent electrolyte.

6. The method of claim 1, where in the waste stream initial salt concentration is at least 5.0M monovalent electrolyte.

7. The method of claim 1, wherein the waste stream initial salt concentration is from 15–85 g/100 mL.

8. The method of claim 1, wherein the waste stream initial salt concentration is from 20–85 g/100 mL.

9. The method of claim 1, wherein the waste stream initial salt concentration is from 50–85 g/100 mL.

10. The method of claim 1, wherein the waste stream initial salt concentration is at least twice that of the salt concentration level in the emulsion feed stream.

11. The method of claim 1, wherein a cation-exchange or anion exchange membrane having a mean water content of at least 0.35 is used, where mean water content is expressed in terms of grams of water per gram of dry membrane.

12. The method of claim 11, wherein a cation-exchange or anion exchange membrane having a mean water content of at least 0.45 is used.

13. The method of claim 1, wherein the silver halide emulsion comprises a gelatin, and the feed stream is maintained at a pH within 0.5 of the isoelectric point of the gelatin.

14. The method of claim 13, wherein the electrodialysis is carried out at a pH within a range of plus or minus 0.2 of the isoelectric point of the gelatin.

15. The method of claim 13, wherein the electrodialysis is carried out at a pH of the isoelectric point of the gelatin.

* * * * *